US010209012B2

(12) United States Patent
Berthelot et al.

(10) Patent No.: US 10,209,012 B2
(45) Date of Patent: Feb. 19, 2019

(54) HEAT EXCHANGER WITH LOUVERED FINS

(71) Applicant: LGL France, Maisons-Alfort (FR)

(72) Inventors: Pierre Berthelot, Beynost (FR); Remy Borg, Genas (FR); Alain Compingt, Grezieu la Varenne (FR); Kapil Sahu, Chennai (IN); Patrick Taurelle, Genas (FR)

(73) Assignee: LGL France, Maisons-Alfort (FR)

( * ) Notice: Subject to any disclaimer, the term of this patent is extended or adjusted under 35 U.S.C. 154(b) by 310 days.

(21) Appl. No.: 15/007,249

(22) Filed: Jan. 27, 2016

(65) Prior Publication Data

US 2016/0245594 A1 Aug. 25, 2016

Related U.S. Application Data

(60) Provisional application No. 62/119,904, filed on Feb. 24, 2015.

(51) Int. Cl.

| | |
|---|---|
| ***F28F 1/32*** | (2006.01) |
| ***F28F 1/20*** | (2006.01) |
| ***F28F 1/30*** | (2006.01) |
| ***F28F 1/12*** | (2006.01) |

(52) U.S. Cl.

CPC ..... *F28F 1/20* (2013.01); *F28F 1/128* (2013.01); *F28F 1/30* (2013.01); *F28F 1/32* (2013.01); *F28F 1/325* (2013.01)

(58) Field of Classification Search

CPC ..... F28F 1/128; F28F 1/325
USPC ..... 165/151, 152
See application file for complete search history.

(56) References Cited

U.S. PATENT DOCUMENTS

| | | | | |
|---|---|---|---|---|
| 4,434,846 | A | 3/1984 | Lu | |
| 4,723,599 | A | 2/1988 | Hanson | |
| 4,923,002 | A * | 5/1990 | Haussmann | F28F 1/32 165/151 |
| 5,289,874 | A | 3/1994 | Kadle et al. | |
| 5,311,935 | A * | 5/1994 | Yamamoto et al. | B60H 1/00328 165/152 |
| 5,360,060 | A | 11/1994 | Tanaka et al. | |
| 5,752,567 | A * | 5/1998 | Obosu | F28F 1/325 165/151 |
| 5,934,363 | A | 8/1999 | Jung et al. | |
| 5,975,199 | A * | 11/1999 | Park | F28F 1/325 165/151 |
| 6,513,587 | B2 * | 2/2003 | Ali et al. | B21D 53/08 165/182 |

(Continued)

FOREIGN PATENT DOCUMENTS

| | | |
|---|---|---|
| EP | 2141434 A1 | 1/2010 |
| EP | 2708841 A1 | 3/2014 |

OTHER PUBLICATIONS

U.S. Appl. No. 62/119,904, filed Feb. 24, 2015, Berthelot, et al.

*Primary Examiner* — Allen Flanigan
(74) *Attorney, Agent, or Firm* — Winstead PC

(57) ABSTRACT

The present application provides a heat exchanger for exchanging heat between a first fluid and a second fluid. The heat exchanger may include a number of fin plates and a number of tubes extending though the fin plates with the first fluid therein. The fin plates may include a number of louvers extending between the tubes such that the second fluid flows through the louvers.

13 Claims, 2 Drawing Sheets

(56) References Cited

U.S. PATENT DOCUMENTS

| | | | | |
|---|---|---|---|---|
| 6,543,527 | B1 * | 4/2003 | Bouzida et al. | F28F 1/128 165/152 |
| 7,380,403 | B2 | 6/2008 | Smah et al. | |
| 7,552,760 | B1 | 6/2009 | Lakhdhar et al. | |
| 2003/0094267 | A1 * | 5/2003 | Young | F28F 1/128 165/152 |
| 2009/0308585 | A1 * | 12/2009 | Chen et al. | F28D 1/0475 165/185 |

* cited by examiner

HEAT EXCHANGER WITH LOUVERED FINS

RELATED APPLICATIONS

The present application is a non-provisional application claiming priority to U.S. Provisional Application Ser. No. 62/119,904, filed on Feb. 24, 2105. U.S. Provisional Application Ser. No. 62/119,904 is incorporated by reference herein in full.

TECHNICAL FIELD

The present application and the resultant patent relate generally to fin and tube type heat exchangers and more particularly relate to a fin and tube type heat exchanger having louvered fins for increased capacity, higher heat transfer, and a reduced pressure drop.

BACKGROUND OF THE INVENTION

Fin and tube type heat exchanges are well known. Generally described, the fins may be in the form of a number of spaced apart parallel plates. The tubes pass through the fins and are attached thereto. A first hot or cold fluid such as a refrigerant flows through the tubes and exchanges heat with a second fluid such as air that flows between the fins.

Known fin and tube type heat exchangers have used fins in the form of a planar plate. Such a planar plate fin may have a low pressure drop but may have high airside thermal resistance. Louvered fins also have been used. The louvered fins may have lower airside thermal resistance but may have a higher pressure drop and may be subject to fouling over time due to the geometry. Other types of fin configurations also may be known.

There is thus a desire for an improved fin and tube type heat exchanger for use with a cooler or other type of refrigerated device. Preferably such an improved fin and tube type heat exchanger may have increased capacity with greater heat transfer with less of a pressure drop therethrough.

SUMMARY OF THE INVENTION

The present application and the resultant patent thus proved a heat exchanger for exchanging heat between a first fluid and a second fluid. The heat exchanger may include a number of fin plates and a number of tubes extending though the fin plates with the first fluid therein. The fin plates may include a number of louvers extending between the tubes such that the second fluid flows through the louvers for heat exchange with the first fluid.

The present application and the resultant patent further provide a method of exchanging heat between a first fluid and a second fluid in a fin and tube heat exchanger. The method may include the steps of flowing the first fluid through a number of tubes, flowing the second fluid though a number of fin plates, forcing the second fluid though a number of louvers in the fin plates, eliminating airflow boundaries on the louvers with the flow of the second fluid, and exchanging heat between the first fluid and the second fluid.

The present application and the resultant patent further provide a heat exchanger for exchanging heat between a first fluid and a second fluid. The heat exchanger may include a number of aluminum fin plate columns and a number of tubes extending though the aluminum fin plate columns with the first fluid therein. The number of aluminum fin plate columns may include a number of louvers extending between the tubes such that the second fluid flows through the louvers for heat exchange with the first fluid.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
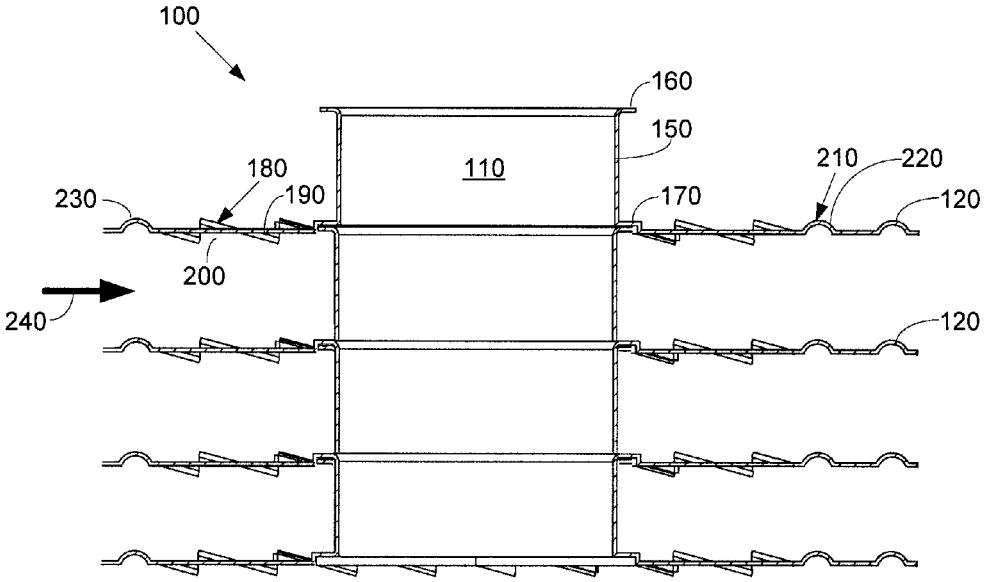
FIG. 1 is a side view of a louvered fin heat exchanger as may be described herein.

Referring now to the drawings, in which like numerals refer to like elements throughout the several views, FIGS. 1-5 show a portion of an example of a heat exchanger 100 as may be described herein. The heat exchanger 100 may be used in a cooler, a refrigerator, or any type of heating, ventilation, or air conditioning application. Likewise, the heat exchanger 100 may have domestic, retail, and/or industrial uses. The heat exchanger 100 may include a number of tubes 110. The tubes 110 may have any suitable size, shape, configuration, or capacity. Any number of the tubes 110 may be used herein. The tubes 110 may be made out of any suitable metal with good heat transfer characteristics. A first fluid such as a refrigerant may flow through the tubes 110.

Figure 3:
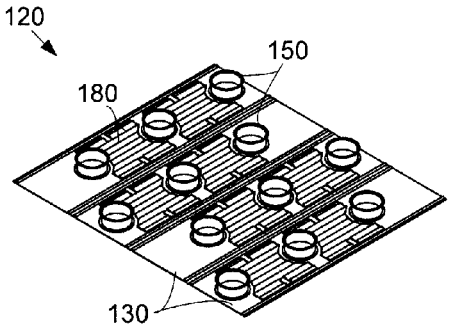
FIG. 3 is a top perspective view of a portion of the array of louvered fin plate columns of FIG. 2.
Figure 4:
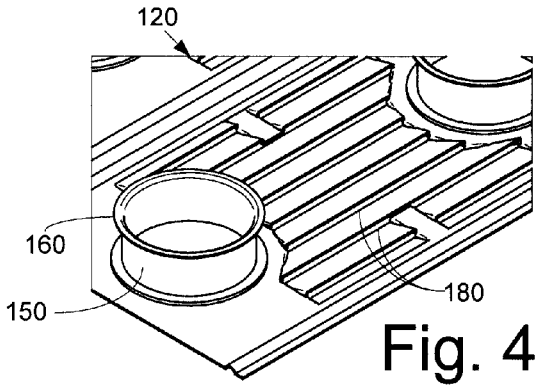
FIG. 4 is a partial, enlarged view of the array of louvered fin plate columns of FIG. 3.
Figure 5:
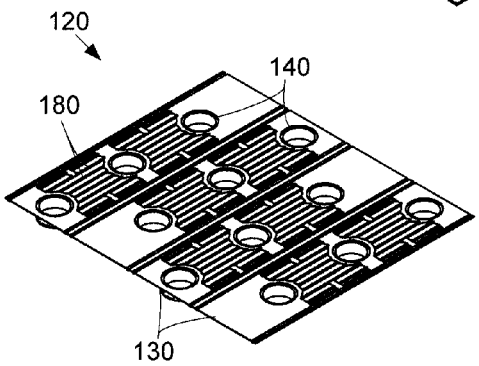
FIG. 5 is a bottom perspective view a portion of the array of louvered fin plate columns of FIG. 2.
Figure 2:
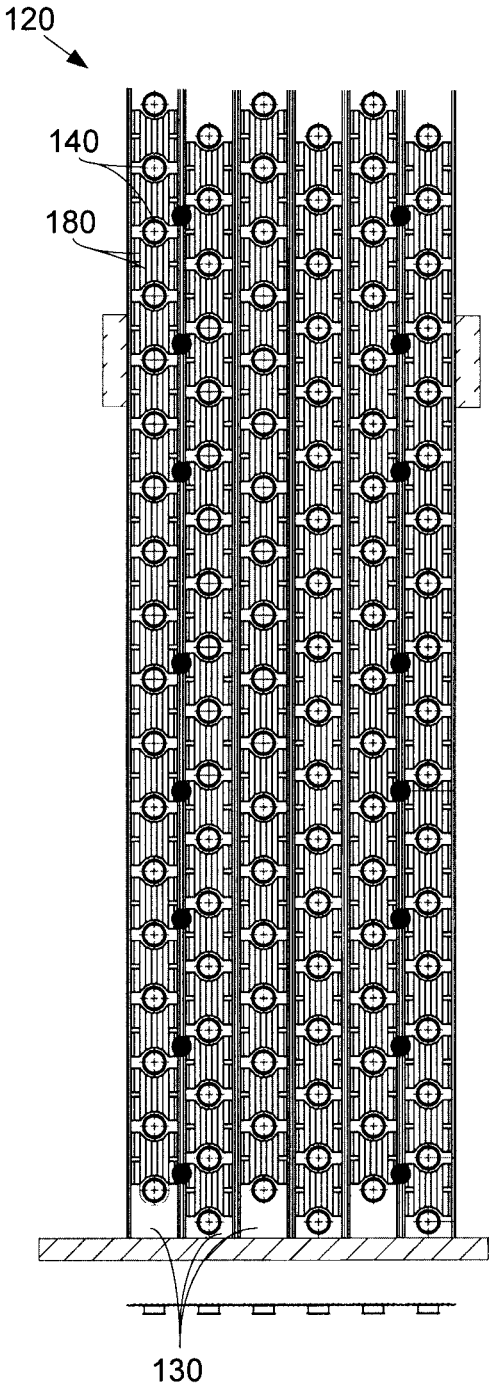
FIG. 2 is a top plan view of an array of louvered fin plate columns for use in the heat exchanger of FIG. 1.

The heat exchanger 100 also may include a number of fin plates 120. Any number of the fin plates 120 may be used herein in any suitable size, shape, configuration, or capacity. The fin plates 120 may be made out of aluminum or any type of metal with good heat transfer characteristics. The fin plates 120 may be arranged in a series of fin plate columns 130. The fin plate columns 130 may have any suitable length or a first dimension. Any number of the fin plate columns 130 may be joined together such that the fin plates 120 as a whole may have any suitable width or a second dimension. For example, six (6) fin plate columns 130 are shown in FIG. 2 while four (4) fin plate columns 130 are shown in FIG. 3 and FIG. 5. Other components and other configurations may be used herein.

Each of the fin plate columns 130 may have a number of tube apertures 140 therein. The tube apertures 140 may have any suitable size, shape, or configuration but are generally sized to accommodate the diameter of the tubes 110 intended to be used therewith. Each tube aperture 140 may be surrounded by a collar 150. The collar 150 may have any suitable height with respect to the fin plate column 130. Specifically, the height of the collar 150 may determine the spacing between the respective tube plates 120. Each collar 150 may have a top mating flange 160 and a bottom mating flange 170. The mating flanges 160, 170 may be sized such that any number of the collars 150 may stacked and nested together as is shown in FIG. 1. Other types of apertures may be used herein. For example, defrost tubes with electric heaters, hot glycol, or other types of heat sources may be used herein. Other components and other configurations may be used herein.

Each fin plate column 130 also may include a number of louvers 180. The louvers 180 may extend between the tube apertures 140 along the length of the fin plate column 130. Although seven (7) louvers 180 are shown herein between the tube apertures 140, any number of the louvers 180 may extend along the width of each fin plate column 130. Each louver 180 may be in the form of an angled plate or slat 190. The angled slat 190 may have any suitable size, shape, or configuration. In this example, the angled slats 190 may have an angle of about ten degrees (10°) to about twenty-five degrees (25°) or so off of the horizontal with about fifteen degrees (15°) or so preferred. Other angles may be used herein. Differing angles also may be used together herein. Each louver 180 may be separated from one another via a louver airflow path 200. The louver airflow path 200 may have any suitable size, shape, or configuration. In this example, the angled slats 190 of the respective louvers 180 may overlap slightly. Other components and other configurations may be used herein.

Each fin plate column 130 may have a number of attachment flanges 210. The attachment flanges 210 may be in the form of a semi-circular boss running along the sides of the each fin plate column 130. Other types of shapes, sizes, and configurations may be used herein. The attachment flanges 210 may be continuous or intermittent. A first side attachment flange 220 of a first fin plate column 130 may attach to a second side attachment flange 230 of a second fin plate column 130. Any number of the fin plate columns 130 may be attached via the attachment flanges 210. Other components and other configurations also may be used herein.

In use, a flow of air 240 flows between each of the fin plates 120 of the heat exchanger 100. The flow of air 240 thus exchanges heat with the first fluid flowing through the tubes 110. The geometry of the louver slats 190 forces the flow of air 240 through the louver airflow paths 200 between the louvers 180. In doing so, any type of airflow boundaries on the louver slates 190 and the fin plates 120 in general may be destroyed or reduced so as to eliminate or reduce overall resistance to heat transfer. The use of the louvers 180 herein thus may increase overall heat exchanger capacity with an increased heat transfer coefficient and less of an airside pressure drop. Moreover, the shape of the louvers 180 described herein do not allow for water stagnation inside of the louver airflow path 200 after a defrost cycle. Specifically, water stagnation may lead to a cycle of water and ice and resultant fin damage. The heat exchanger 100 described herein thus provide increased efficiency, more airflow given less of a pressure drop, and more capacity given the better airflow and heat transfer.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A heat exchanger for exchanging heat between a first fluid and a second fluid, comprising:

a plurality of fin plates, each fin plate of the plurality of fin plates comprising a planar portion;

a plurality of louvers disposed on the planar portion of each fin plate of the plurality of fin plates, each louver of the plurality of louvers comprising an angled slat that includes a leading edge that extends above the planar portion and a trailing edge that extends beneath the planar portion;

wherein each fin plate of the plurality of fin plates includes an attachment flange that comprises a semi-circular boss; and wherein adjacent fin plates of the plurality of fin plates are attached together via the attachment flanges.

2. The heat exchanger of claim 1, wherein the plurality of fin plates are made of aluminum.

3. The heat exchanger of claim 1, wherein the heat exchanger comprises a plurality of fin plate columns.

4. The heat exchanger of claim 1, wherein each fin plate of the plurality of fin plates comprises a plurality of tube apertures.

5. The heat exchanger of claim 4, wherein each aperture of the plurality of tube apertures comprises a collar.

6. The heat exchanger of claim 5, wherein each collar comprises a top mating flange and a bottom mating flange.

7. The heat exchanger of claim 1, wherein each angled slat comprises an angle of about fifteen degrees (15°) relative to the planar portion.

8. The heat exchanger of claim 1, further comprising a louver airflow path that passes between adjacent angled slats.

9. The heat exchanger of claim 8, wherein a leading edge of a first angled slat overlaps a trailing edge of a second angled slat when the first and second angled slats are viewed from a side of the heat exchanger.

10. A method of exchanging heat between a first fluid and a second fluid in a fin and tube heat exchanger, comprising:

flowing the first fluid through a plurality of tubes;

flowing the second fluid between a plurality of fin plates, the plurality of tubes extending through the plurality of fin plates, each fin plate of the plurality of fin plates comprising a planar portion having a plurality of louvers disposed on the planar portion, each louver of the plurality of louvers comprising an angled slat that includes a leading edge that extends above the planar portion and a trailing edge that extends beneath the planar portion;

exchanging heat between the first fluid and the second fluid;

wherein each fin plate of the plurality of fin plates includes an attachment flange that comprises a semi-circular boss; and wherein adjacent fin plates of the plurality of fin plates are attached together via the attachment flanges.

11. A heat exchanger for exchanging heat between a first fluid and a second fluid, comprising:

a plurality of fin plate columns;

a plurality of tubes with the first fluid therein extending through the plurality of fin plate columns;

wherein each fin plate column of the plurality of fin plate columns comprises a planar portion with a plurality of louvers extending between the plurality of tubes such that the second fluid flows through the plurality of louvers, each louver of the plurality of louvers comprising an angled slat that includes a leading edge that extends above the planar portion and a trailing edge that extends beneath the planar portion;

wherein each fin plate of the plurality of fin plate columns includes an attachment flange that comprises a semi-circular boss; and wherein adjacent fin plates of the plurality of fin plate columns are attached together via the attachment flanges.

12. The heat exchanger of claim 11, wherein each fin plate column of the plurality of fin plate columns comprises a plurality of tube apertures and collars.

13. The heat exchanger of claim 11, wherein each angled slat comprises an angle of about fifteen degrees (15°) relative to the planar portion.

* * * * *